US007371206B2

(12) United States Patent
Eigemeier et al.

(10) Patent No.: US 7,371,206 B2
(45) Date of Patent: May 13, 2008

(54) ROTOR FOR LABORATORY CENTRIFUGES

(75) Inventors: Frank Eigemeier, Osterode-Dorste (DE); Susanne Kroll, Dresden (DE); Raimund Grothaus, Dresden (DE)

(73) Assignee: Thermo Electron LED GmbH, Langenselbold (DE)

( * ) Notice: Subject to any disclaimer, the term of this patent is extended or adjusted under 35 U.S.C. 154(b) by 0 days.

(21) Appl. No.: 11/314,823

(22) Filed: Dec. 22, 2005

(65) Prior Publication Data

US 2006/0183620 A1 Aug. 17, 2006

(30) Foreign Application Priority Data

Dec. 23, 2004 (DE) ..... 10 2004 062 231

(51) Int. Cl.
*B04B 5/02* (2006.01)

(52) U.S. Cl. ..... 494/16

(58) Field of Classification Search ..... 494/16, 494/31, 33; 422/72

See application file for complete search history.

(56) References Cited

U.S. PATENT DOCUMENTS

| | | | | | |
|---|---|---|---|---|---|
| 4,221,325 | A | * | 9/1980 | Kubota | 494/14 |
| 4,278,202 | A | | 7/1981 | Westberg | |
| 4,484,906 | A | * | 11/1984 | Strain | 494/16 |
| 4,553,955 | A | | 11/1985 | Lam et al. | |
| 4,801,290 | A | * | 1/1989 | Gunter | 494/16 |
| 4,832,679 | A | * | 5/1989 | Bader | 494/16 |
| 5,362,300 | A | * | 11/1994 | Christensen | 494/16 |
| 5,411,465 | A | | 5/1995 | Glen et al. | |
| 5,562,582 | A | | 10/1996 | Malekmadani | |
| 5,562,583 | A | * | 10/1996 | Christensen | 494/16 |
| 6,579,217 | B1 | * | 6/2003 | Buxton | 494/20 |
| 2003/0203800 | A1 | | 10/2003 | Aizawa et al. | |
| 2006/0166802 | A1 | * | 7/2006 | Eigemeier | 494/16 |
| 2006/0183620 | A1 | * | 8/2006 | Eigemeier et al. | 494/16 |

FOREIGN PATENT DOCUMENTS

| | | | | |
|---|---|---|---|---|
| DE | 1782602 | B | | 9/1968 |
| DE | 3334655 | A1 | * | 4/1985 |
| DE | 3703514 | A1 | | 5/1987 |
| DE | 3724091 | C1 | | 7/1987 |
| DE | 19723613 | A1 | | 6/1997 |
| DE | 10001635 | A1 | | 1/2000 |
| EP | 0882512 | A1 | | 12/1998 |
| GB | 2098516 | A | | 11/1982 |
| JP | 62106857 | A | | 5/1987 |
| JP | 7-47302 | | * | 2/1995 |

* cited by examiner

*Primary Examiner*—Charles E. Cooley
(74) *Attorney, Agent, or Firm*—Baker & Hostetler LLP

(57) ABSTRACT

The present invention relates to a rotor for laboratory centrifuges, the rotor including a rotor housing that is open to the top and at least one recess for taking up centrifuge containers, with the recess being formed in the peripheral area of the rotor as a concentric, circumferential ring trough having an inner wall and an outer wall and with the ring trough being stiffened in a spoke-type manner in such a way using centrifuge containers that are distributed radially and over the circumference of the ring trough that the centrifuge containers support the inner wall and the outer wall rigidly against one another. Furthermore, an adapter for receiving a sample container and for use in such a rotor is suggested.

16 Claims, 7 Drawing Sheets

ROTOR FOR LABORATORY CENTRIFUGES

BACKGROUND OF THE INVENTION

1. Field of the Invention

The present invention relates to a rotor for laboratory centrifuges wherein said rotor comprises a rotor housing that is open to the top and has at least one recess for taking up centrifuge containers, wherein the recess is formed in the peripheral area of the rotor as a concentric circumferential ring trough with an inner wall and an outer wall and also an adapter for taking up a sample container and for use in such a laboratory centrifuge rotor.

2. Description of the Related Art

In this context, a centrifuge container can firstly be a sample container in which the samples to be centrifuged are arranged. Secondly, a centrifuge container can also be an adapter that can be inserted into a rotor and into which a sample container can in turn be inserted.

A rotor for a laboratory centrifuge is used in order to take up centrifuge containers in which material to be centrifuged is contained. A centrifuge container, such as, for example, a test tube, can be placed in a cylindrical recess, a plurality of which is provided in a rotor, as disclosed in the patent application U.S. Pat. No. 5,411,465.

An angular cap for centrifuges is described in the patent application DE 37 03 514 A1, wherein said angular cap has a recess for taking up sample material. The recess is designed in the peripheral area of the rotor as a concentric circumferential annular groove that is bordered on its edge seen in the direction of the rotor axis by an axially symmetrical, upwardly tapering truncated cone. The outer wall of the annular groove is designed in the form of an upwardly tapering hollow truncated cone. Centrifuge containers are arranged in a row in the recess of the rotor. The design of the recess as a annular groove reduces the weight of the rotor which in turn acts advantageously on the centrifugation properties of the rotor; thus for example in case of a constant rotational speed, the centripetal force acting on the rotor is reduced. On the other hand, the circumferential recess reduces the stability of the rotor since the smaller mass and the design as a hollow truncated cone reduces the resistance of the rotor peripheral area compared to the centrifugal force. Thus this can result in breakage on the rotor housing and damages, especially in the lower peripheral area of the annular groove wherein said peripheral area protrudes over the rotor hub. Also, due to the design as an annular groove, for example, an uneven filling of the centrifuge containers or an uneven loading of the centrifuge can amount to an ovalization of the rotor body during the centrifugation process. This causes unbalances and brings about an unsafe centrifugation.

Furthermore, the required high production accuracy in this construction involves the risk of the occurrences of inaccuracies in the fit of the centrifuge containers in the annular groove, which in turn can result in constantly changing unbalances and resonance vibrations in case of certain number of revolutions.

SUMMARY OF THE INVENTION

Against this background, the object of the present invention is to create a rotor and also an adapter of the aforementioned type that has improved stability and higher running smoothness. This object is achieved by the rotor for laboratory centrifuges including a rotor housing that is open to the top and at least one recess for taking up centrifuge containers, wherein the recess is formed in the peripheral area of the rotor as a concentric circumferential ring trough having an inner wall and an outer wall, characterized in that the ring trough is stiffened in a spoke-type manner in such a way using centrifuge containers that are distributed radially and over the circumference of the ring trough that the centrifuge containers support the inner wall and the outer wall rigidly against one another, characterized in that the maximum wall thickness of the centrifuge containers in the rotor circumferential direction is greater than the maximum wall thickness of the centrifuge containers in the rotor radial direction. This object is also achieved by the the adapter for taking up a sample container and for use in a rotor for laboratory centrifuges wherein said rotor has a rotor housing that is open to the top and has at least one recess for taking up at least one adapter, wherein the recess is formed in the peripheral area of the rotor as a concentric circumferential ring trough having an inner wall and an outer wall, characterized in that the maximum wall thickness of the adapter in the rotor circumferential direction is greater than the maximum wall thickness of the adapter in the rotor radial direction. Preferred embodiments are specified in the respective dependent claims.

The rotor according to the invention for laboratory centrifuges comprises a rotor housing that is open to the top and has at least one recess for taking up at least one centrifuge container, wherein the recess is formed in the peripheral area of the rotor as a concentric circumferential ring trough having an inner wall and an outer wall. The inner wall is preferably designed, seen in the direction of the rotor axis, as an axially symmetrical, upwardly tapering truncated cone and the outer wall is designed as an upwardly tapering hollow truncated cone. Furthermore, the ring trough is stiffened in a spoke-type manner in such a way by radially arranged centrifuge containers distributed over the circumference of the ring trough that the centrifuge containers rigidly support the inner wall and the outer wall against one another. The centrifuge containers are designed for stiffening the ring trough so that the ring trough equipped with the essentially evenly distributed centrifuge containers acts similar to a "spoked wheel." An ovalization of the rotor body is avoided. By supporting the inner wall and the outer wall against one another, the ring trough can resist stronger centrifugal forces. The spoke effect of the centrifuge containers is especially advantageous in shell rotors.

In a preferred embodiment, the maximum wall thickness of the centrifuge containers in the rotor circumferential direction is greater than the maximum wall thickness of the centrifuge containers in the rotor radial direction. By increasing the wall thickness of the centrifuge containers in the circumferential direction, the stability of the rotor can be improved such that the ability of the rotor housing to absorb centrifugal forces acting in the radial direction increases. Due to the greater maximum wall thickness in the circumferential direction, the centrifugal forces acting on the rotor housing can be distributed on a larger cross-sectional area, by which the stress on the individual centrifuge containers acting as spokes reduces on the whole. It is preferable that the wall thickness in the circumferential direction is increased over the entire length of the centrifuge container and that the wall thicknesses are designed to be constant both in the radial direction and also in the circumferential direction. The shape of the walls of the centrifuge containers can basically be designed randomly as long as the maximum wall thickness in the circumferential direction is greater than in the radial direction. Furthermore, the reinforcement of the spoke effect of the centrifuge containers reduces the risk of damages to the rotor.

In another preferred embodiment the centrifuge containers lie flatly against the inner side of the outer wall of the ring trough. By this it is ensured that no punctiform loads affect the centrifuge containers acting as spokes. Instead of that, the centrifugal forces can be transferred over the contact surface, improving the stability of the rotor on the whole and reducing the risk of damages to the centrifuge container. In addition to the flat contact against the inner side of the outer wall, the centrifuge containers can also lie flatly against the inner side of the inner wall of the ring trough.

In order to ensure a flat contact of the centrifuge containers against the inner side of the outer wall, it is preferable to provide in the inner side of the outer wall recesses that are designed for taking up the centrifuge containers. In addition, the centrifuge containers are positioned in the circumferential direction of the ring trough by designing the recesses. This results in a reduction of unbalances and a better running smoothness. Additionally, it is preferred to design corresponding recesses on the inner side of the inner wall of the ring trough.

Each of the recesses preferably has a first radius that is greater than half the distance between the outer side of the inner wall and the outer side of the outer wall of the ring trough. This is advantageous since a greater contact surface is thus created for the centrifuge containers to be inserted into the ring trough. The centrifuge containers must be designed in such a way that they can be fitted into the recess with positive locking. Thus the material loss resulting from the larger recesses in the ring trough are filled in by a corresponding design of the centrifuge containers. In case of a secure contact for the centrifuge containers, high speeds can thus be achieved with low bearing load of the rotor.

In another preferred embodiment, the first radius belongs to a first circular arc segment to each of whose ends is attached another circular arc segment having a second radius that is smaller than the first radius. By means of the circular arc segment having the second radius, forces in the circumferential direction of the ring trough can thus be absorbed even better so that the centrifuge containers can be held more securely. Furthermore, it is thus possible to create a maximum contact surface in which the centrifuge containers can fit securely both in the radial direction of the rotor and also in the circumferential direction of the rotor. By means of the radii it is possible to see to it that only low stress concentration arises in the material of the ring trough and/or of the rotor housing.

According to another embodiment of the present invention, the recesses are designed such that they taper conically towards the bottom of the ring trough. Thus a still better fit of the centrifuge containers in the ring trough is achieved.

For reinforcing the spoke effect of the centrifuge containers distributed over the circumference of the ring trough, it is expedient to provide at least one hold-down device by which the centrifuge containers are held in the rotor and secured against displacement on the longitudinal axis. By the presence of a hold-down device, the centrifuge containers are fixed in the axial direction and are thus secured against unintended or unauthorized removal. In addition to the pure protection against axial displacement, a contact pressure of the centrifuge containers on the rotor can be created by means of the hold-down device. For this purpose, a force acting on the longitudinal axis is applied on the centrifuge containers using at least one hold-down device. The application of a force acting on the longitudinal axis on the centrifuge containers using the hold-down device reinforces the spoke effect and further improves the stiffening of the centrifuge. Simultaneously the stability of the bearing of the centrifuge containers in the rotor is improved.

The centrifugal force acting on the rotor results in ovalization effects during the centrifugation process not only on the rotor body but also on the individual centrifuge containers. In order to prevent these ovalization effects on the centrifuge containers, wherein said effects reduce the stability of the entire rotor, it is expedient to provide the centrifuge containers with a rigid lid. The lid stiffens the centrifuge containers and prevents an ovalization. The lids are preferably also designed for the purpose of sealing the centrifuge containers tightly. The lid can be attached to the centrifuge containers, for example, using screw threads or clips. The lid is preferably designed from carbon fiber-reinforced plastic or metal. Alternatively it is advantageous to manufacture the lid from break-proof, transparent plastic. Due to this, it is possible, in case of a centrifuge container designed as an adapter, to see before opening the lid whether, for example, the sample container located in the adapter was damaged during the centrifugation process. Furthermore, it is expedient if the lid is designed to close the centrifuge container in a bio-proof manner. In doing so, it is possible to prevent biologically hazardous material from escaping from the centrifuge container.

According to another embodiment of the invention, the rotor housing is designed from a metal, a metal alloy or a fiber-reinforced plastic. In a design from metal or a metal alloy, it is especially preferable to use a light metal and/or a light-metal alloy. By this it is possible to manufacture an easy and very robust design of the rotor housing and/or the rotor according to the invention and thus achieve a low torque of inertia. Examples of suitable light-metal materials are aluminum or titanium. This is advantageous since only a small weight thus needs to be set into rotation and thus the torque of inertia of the rotor housing has a low value. In case sufficient stability can be ensured, it is also possible to use a carbon fiber-reinforced plastic as the material for the rotor housing. In order to keep the unbalance of the rotating rotor housing as low as possible, it is practical to equip all the recesses in the ring trough with centrifuge containers. The recesses are preferably formed at a regular distance from one another, for example at an angle of 60° with respect to the rotor axis.

According to another embodiment of the invention, centrifuge containers are manufactured at least partly from metal or a metal alloy. By the use of metal or a metal alloy, a self-supporting structure of the centrifuge containers is ensured and the force absorption ability of the containers is improved. For example, steel, aluminum or titanium can be used for the manufacture.

Alternatively or additionally, the centrifuge containers are manufactured at least partly using carbon fiber composite design. By this the weight of the centrifuge containers can be reduced and simultaneously high stability of the individual containers can be achieved. It is preferred to manufacture those regions of the centrifuge containers that are designed with the carbon fiber composite design using the so-called "winding technology." Here, a core or a sleeve, also called "liner" is wound with carbon fibers. The liner remains in the component and can be manufactured from metal or plastic. Furthermore, it can have varying wall thicknesses in the rotor radial direction and in the rotor circumferential direction. After the winding, the liner remains in the centrifuge container and forms a part of the same. By this hybrid design the stability of the centrifuge containers is further improved and simultaneously a relatively low weight is achieved, thus in turn improving the centrifugation properties of the rotor on the whole. Alternatively, the liner can also be pressed into or glued into the centrifuge container after the latter is manufactured. It can cover the entire inner surface of the centrifuge container or can be present only in sections thereof. Furthermore, the liner can be designed to take up the lid of the centrifuge container. For this purpose it is preferred if the liner comprises in the opening region of the centrifuge container a thread that corresponds to the counter-thread on the lid.

In another preferred embodiment, the ring trough comprises on its bottom region positioning means to position the centrifuge containers. This positioning can take place alternatively or additionally to the positioning of the centrifuge containers using the recesses in the inner sides of the outer wall and the inner wall. The positioning means are designed, for example, as protrusions or as latches that engage in corresponding depressions or holes in the bottom region of the centrifuge containers. This positioning takes place preferably in the rotor circumferential direction. In addition, a positioning in the rotor radial direction is also possible.

The present invention further relates to an adapter for a sample container, said adapter being capable of being inserted into the afore-described rotor housing of the rotor. Furthermore, the maximum wall thickness of the adapter in the rotor circumferential direction is greater than the maximum wall thickness of the adapter in the rotor radial direction. The spoke effect of the adapter is thus improved and the stability of the rotor is consequently increased.

In a preferred embodiment, the adapter has an oval-shaped outer contour. In this context, the outer contour is relevant in a cross-sectional view of the adapter. It is preferred if the oval-shaped design exists essentially along the entire length of the adapter. In the state in which the adapter is inserted into the rotor trough, the adapter is aligned in such a way that the long sides of the oval-shaped adapter, at least in the region of its vertex points, lie against the inner walls of the rotor trough. The contact can take place directly against the rotor wall or in recesses provided for this purpose. The adapter lies flatly against the wall at least in the region of the inner side of the outer wall. The oval-shaped design of the adapter increases the contact surface of the adapter against the inner side of the outer wall so that forces can be applied on the adapter such that they are distributed over a larger area and a more secure bearing of the adapter results. The overall stability is thus improved, especially compared to the circular outer contour known from prior art. Simultaneously by the oval-shaped design the wall thickness of the wall in the circumferential direction can be increased in a manner that facilitates manufacture.

Alternatively, it is preferred if the adapter has an essentially triangular outer contour. Here, it must be ensured that in its state of being inserted into the ring trough, the adapter lies with one side flatly against the inner side of the outer wall of the ring trough. This is advantageous since this design of the adapter is firstly easy to manufacture and secondly is especially suitable for the flat contact of the adapter against the inner side of the outer wall. By using the triangular outer contour, the wall thickness in the circumferential direction can provided with a reinforced design without more expenditure.

In another embodiment, the adapter is provided eccentrically to its centerline with a recess into which a sample container can be inserted. The adapter is arranged in the rotor in such a way that the middle distance from the centerline of the sample container to the inner side of the outer wall is smaller than the middle distance from the centerline of the sample container to the inner side of the inner wall. Thus in comparison with the situation in which the centerline of the sample container corresponds with the centerline of the adapter, a greater distance from the sample container to the rotor centerline and thus higher rotation speeds can be achieved in the region of the centrifuged product.

In another embodiment, the adapter is glued into the ring trough. By gluing the contact surface of the adapter against the ring trough, the stiffening effect of the adapter is further increased. By gluing, even tractive forces and shearing forces can be absorbed by the adapter in addition to the compressive forces. In adapters arranged circumferentially in the ring trough, it is also possible to glue only a few adapters and to insert the others into the ring trough in an unglued form.

BRIEF DESCRIPTION OF THE DRAWING

In the following description the invention is explained in more detail on the basis of the embodiments illustrated schematically in the drawing of which.

DESCRIPTION OF THE PREFERRED EMBODIMENTS

Figure 1:
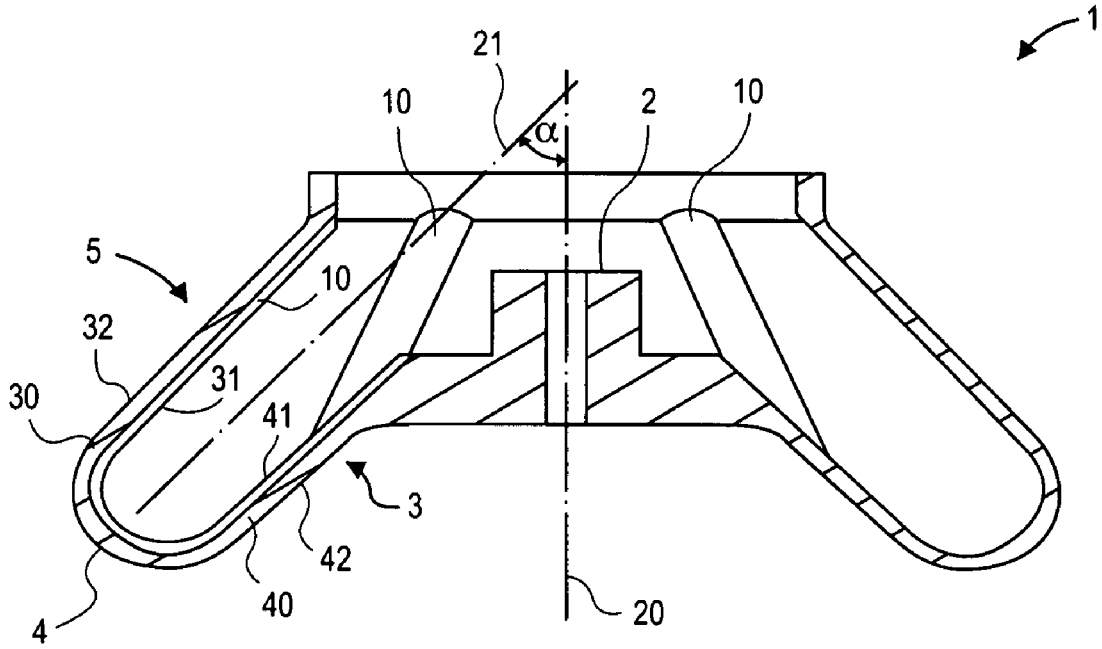
FIG. 1 illustrates a longitudinal section through a rotor having a recess located in the cut surface.

Like reference numerals are used for like parts in the figures.

FIG. 1 illustrates the longitudinal section of a monolithic rotor housing 1 whose rotor hub 2 is arranged centrically in the middle part of an upwardly tapering truncated cone 3 that together with the rotor hub 2 forms the middle region of the rotor housing. The truncated cone 3 is a part of a ring trough 4 and forms a large part of its inner wall 40. Furthermore, the ring trough has an upwardly tapering hollow truncated cone 5 on the side opposite to the truncated cone 3, wherein the truncated cone 5 forms the outer wall 30 of the rotor housing 1. The ring trough 1 has in inner side of the inner wall 41 and an inner side of the outer wall 31 and also an outer side of the inner wall 42 and an outer side of the outer wall 32. The outer peripheral region is formed by the ring trough 4. The rotor rotation axis 20 extends centrally through the rotor hub 2 wherein the centerline 21 of the ring trough 4 forms an angle $\alpha$ of approximately 45° with the rotor rotation axis 20. The angle $\alpha$ can have other values in other preferred embodiments. The ring trough 4 comprises several recesses 10 that are provided on the inner side of the outer wall 31.

Figure 2:
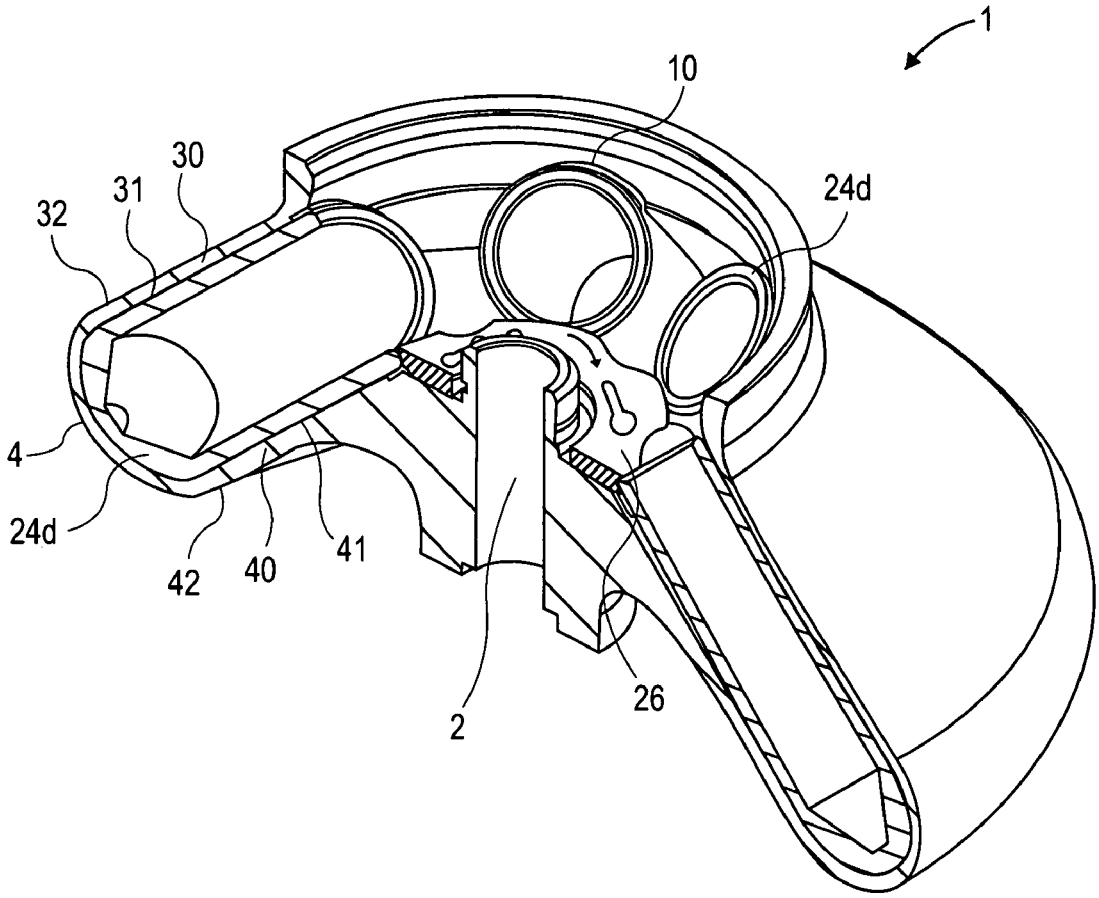
FIG. 2 illustrates a perspective view of a longitudinal section through a rotor having inserted adapters.

FIG. 2 illustrates a perspective view of a longitudinal section of a rotor in which adapters 24*d* are arranged such that they are evenly distributed in the circumferential direction. The adapters 24*d* are designed to be essentially cylindrical and lie in recesses 10 that are designed in the inner side of the outer wall 31. The circumferential arrangement of the adapters 24*d* in a row in the ring trough 4 stiffens the latter in a spoke-type manner. Even in case of an uneven loading of the rotor, if, for example, only a few of the adapters 24*d* are loaded with sample containers (not illustrated here) and others remain empty, there is no ovalization of the rotor body 1 since the adapters 24*d* act as spokes. The adapters 24*d* are designed for absorbing both compressive forces and also tractive forces. A hold-down device 26 designed as a ring disk is present concentrically around the rotor hub 2. The hold-down device 26 can turn back and forth between two stops and releases the adapters 24*d* in a release position and fixes the same in a hold position. The hold-down device 26 is designed in such a way that in the hold position it applies a normal force on the adapters 24*d* due to which the adapters are pressed against the ring trough 4. The spoke effect of the adapters 24*d* is thus increased. The hold-down device 26 is dimensioned in such a way that sample containers can be inserted and run in the adapters 24*d* at all times, even in the hold position.

Figure 3:
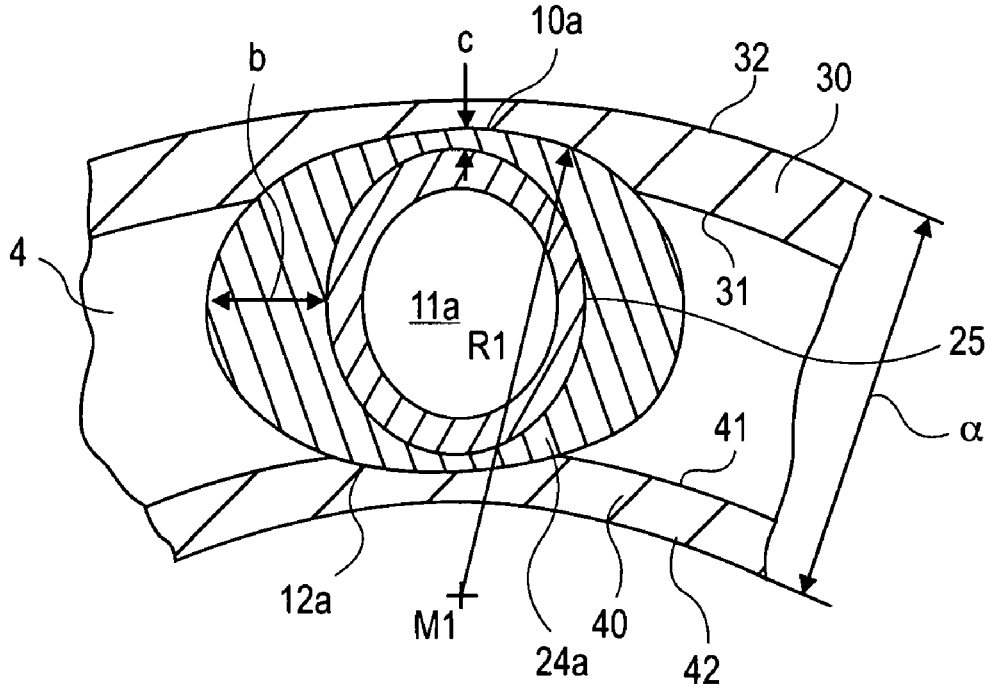
FIG. 3 illustrates the top view of a partial section of the rotor housing having an oval-shaped adapter.

FIG. 3 illustrates the top view of a partial section of the rotor housing. In the inner side of the outer wall 31, a recess 10*a* is designed that lies opposite to a recess 12*a* designed in the inner side of the inner wall 41. A centrifuge container designed as an adapter 24*a* lies flatly in these recesses 10*a*, 12*a*. In the adapter 24*a*, a cylindrical recess 25 is designed into which a sample container 11*a* is inserted with positive locking. The centerlines of the adapter 24*a* and that of the sample container 11*a* coincide, i.e. the sample container 11*a* is arranged in the center of the adapter 24*a*. It is enough if the sample container 11*a* is inserted into the associated adapter 24*a* with a clearance fit. The adapter 24*a* comprises an oval-shaped outer contour, wherein each adapter lies with the region of the vertex points of its long sides in the recesses 10*a*, 12*a*. It must be understood that the maximum wall thickness b of the adapter 24*a* in the circumferential direction of the ring trough 4 is greater than the wall thickness c in the rotor radial direction. Furthermore, the recess 10*a* in its top view has the shape of a circular arc segment, wherein the circular arc has a first radius R1. The center M1 belonging to the first radius R1 is arranged outside the ring trough and is located on the side oriented towards the centerline of the rotor. The first radius R1 is greater than half the distance between the outer side of the inner wall 42 and the outer side of the outer wall 32. The distance between the two outer sides 32, 42 is indicated with "a" in FIG. 2. The recess 12*a* on the inner side of the inner wall 41 of the ring trough 4 can also be provided with a radius R1. This is advantageous since thus a sample container, which is inserted into the ring trough 4 such that it comes, in the region of the recess 12*a* as completely as possible in contact with this recess 12*a*, can achieve a still greater contact surface on the whole and thus a more secure hold in the ring trough 4.

Figure 4:
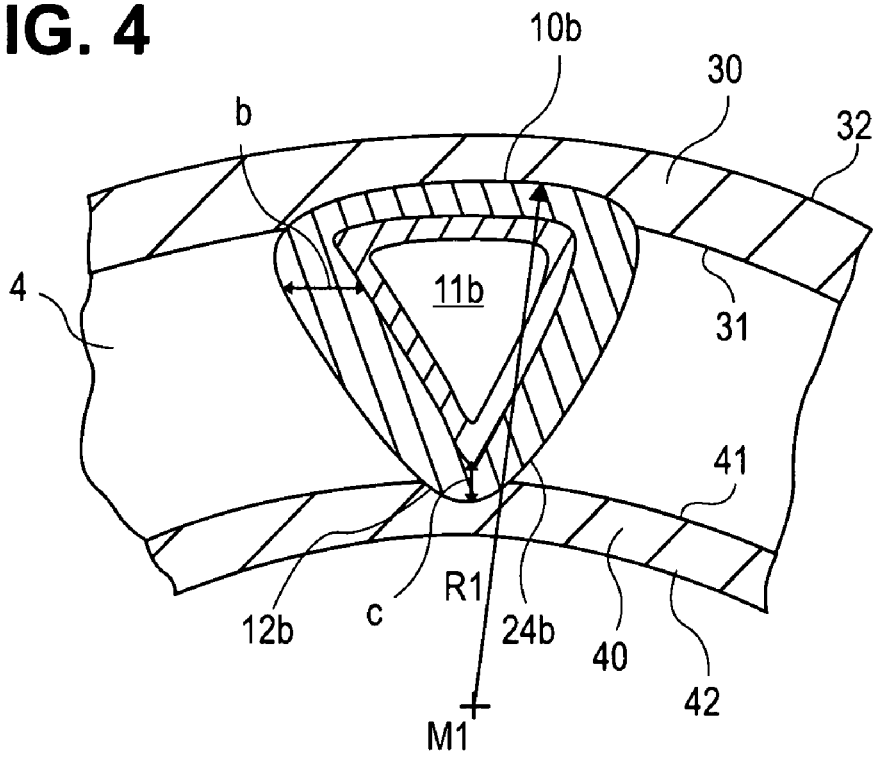
FIG. 4 illustrates the top view of a partial section of the rotor housing having a triangular sample container.

The centrifuge container can also be designed as triangular. A correspondingly shaped adapter 24*b* is illustrated in FIG. 4. Both the inner and also the outer contour of the adapter 24*b* are designed as triangular. As a result, also the sample container 11*b* inserted into the adapter 24*b* is designed as triangular. Here also the maximum wall thickness b in the circumferential direction is greater than the maximum wall thickness c in the radial direction. The sides of the triangle are not provided as straight lines but as circular arc segments. A vertex of the triangle can engage in the inner side of the inner wall 31, wherein the vertex can also be designed to be rounded, see recess 12*b* in FIG. 3. Basically, the circular arc segment can also be replaced by a geometry that is similar to a circular arc. Instead of the triangular shape having triangle sides that are designed to be circular arc-shaped, triangle sides representing a cycloid can also be used. The outer contour of such a centrifuge container then corresponds essentially to a three-curved epitrochoid. One triangle side of the adapter 24*b* lies essentially completely in the recess 10*b*. Here also, the recess 10*b* has a first radius R1.

Figure 5:
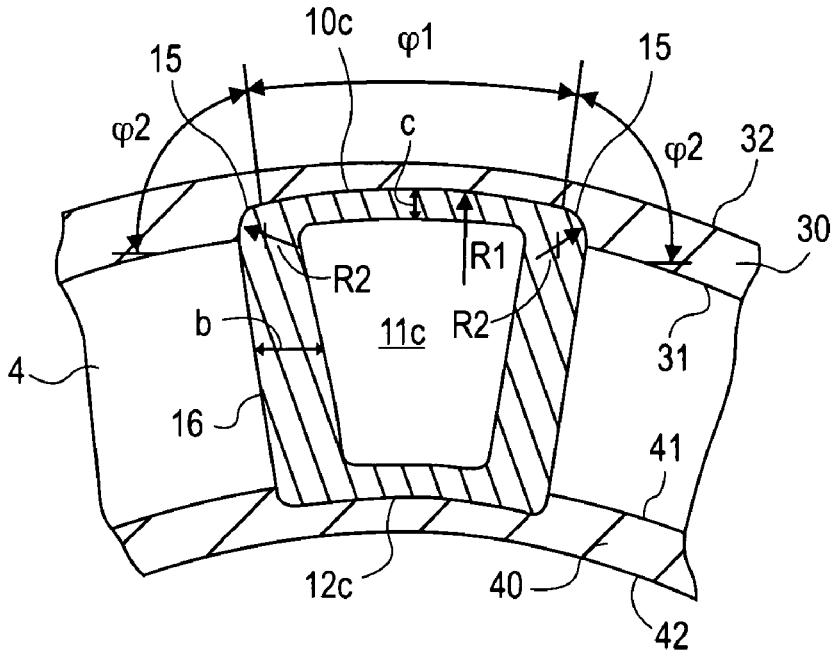
FIG. 5 illustrates the top view of a partial section of the rotor housing having a trapezoid sample container.
Figure 6:
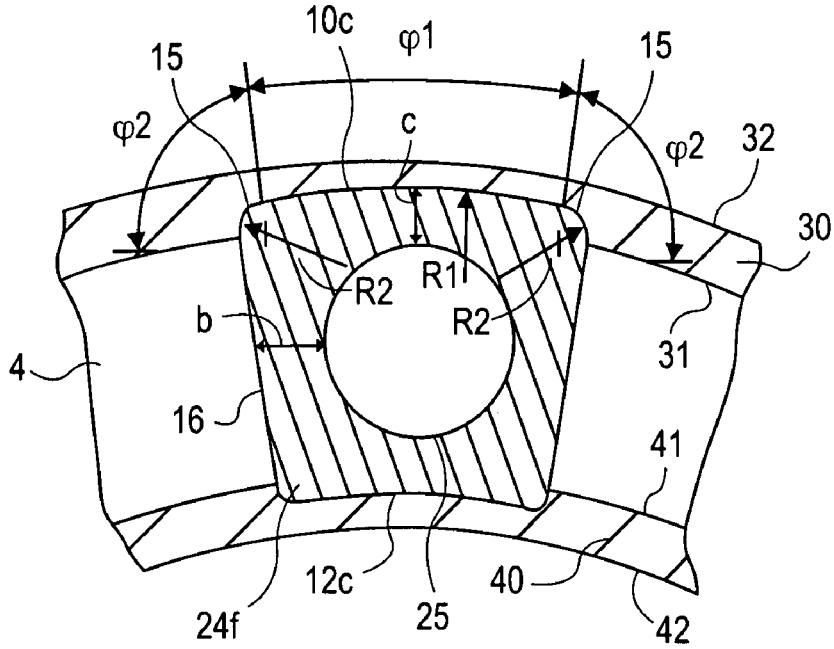
FIG. 6 illustrates the top view of a partial section of the rotor housing having a trapezoid adapter.
Figure 7:
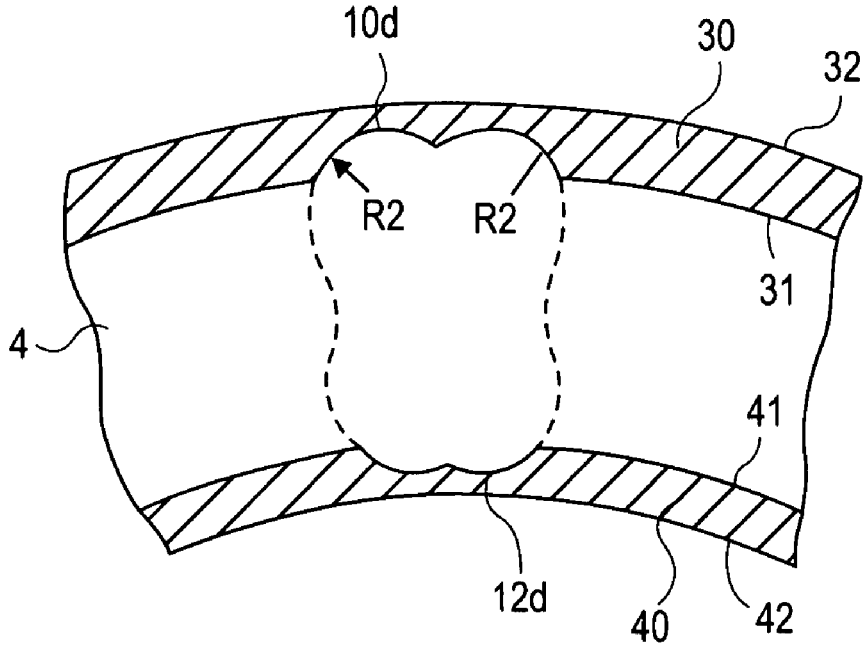
FIG. 7 illustrates the top view of a partial section of the rotor housing having recesses consisting of two circular arc segments.

In order to be able to absorb forces well in the radial direction and in the circumferential direction of the rotor, an embodiment is suggested according to FIG. 5. The inner sides 31 and 41 of the ring trough 4 are provided with recesses 10*c*, 12*c* that result from a combination of different radii. The recess 10*c* has a first circular arc segment with an arc angle $\phi$1, wherein attached to the ends of this circular arc segment is an additional circular arc segment in each case having a second radius R2 that is smaller than the first radius R1. Each second circular arc segment 15 has an arc angle $\phi$2. In the extreme case the radius R1 is infinite so that a straight line is present between the two circular arc segments 15. Should the portion of the arc angle $\phi$1 tend to 0° in the borderline case, the two circular arc segments with the contour 15 contact one another resulting in the recesses 10*d*, 12*d* illustrated in FIG. 7. The circular arc segments 15 can also be designed as a roulette (cycloid) or curve of the fourth order (e.g. cardioid). The sample container 11*c* from FIG. 5 has an almost trapezoid outer contour wherein the sides lying in the recesses 10*c*, 12*c* are designed as circular arc segments. FIG. 6 illustrates an adapter 24*f* whose outer contour resembles that of the sample container 11*c* from FIG. 5. In the adapter 24*f* a circular recess 25 is provided that is designed for absorbing a cylindrical, conventional sample container (not illustrated here). By the relatively large contact surfaces of the adapter 24*f* against the inner sides 31 and 41, forces in the radial direction can be absorbed and transferred especially well.

Figure 8:
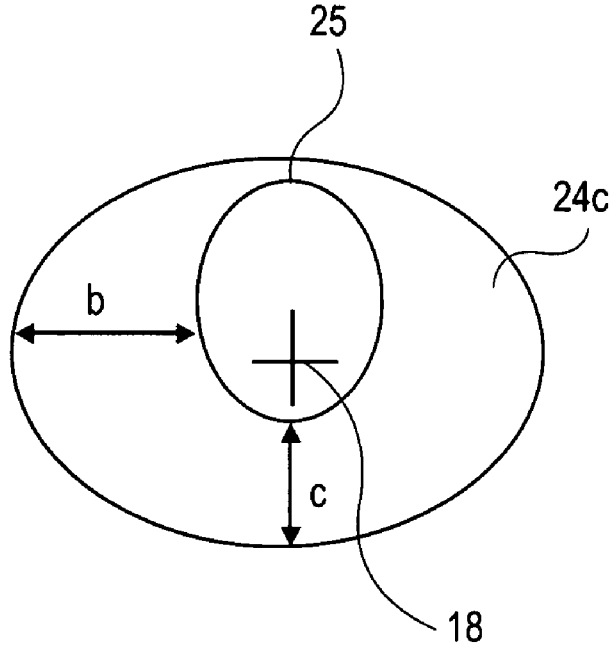
FIG. 8 illustrates an adapter having an eccentrically arranged sample container.

FIG. 8 illustrates the top view of an adapter 24*c* that has an oval-shaped outer contour. A recess 25 is designed in the adapter 24*c* for receiving a cylindrical sample container (not illustrated here) with positive locking. The position of the circular recess 25 inside the adapter 24*c* is eccentric. The recess 25 is arranged outside the center 18 of the oval-shaped adapter 24*c*. Furthermore, the recess 25 is arranged in such a way that its centerline is aligned essentially parallel to the centerline of the adapter 24*c*.

Figure 9:
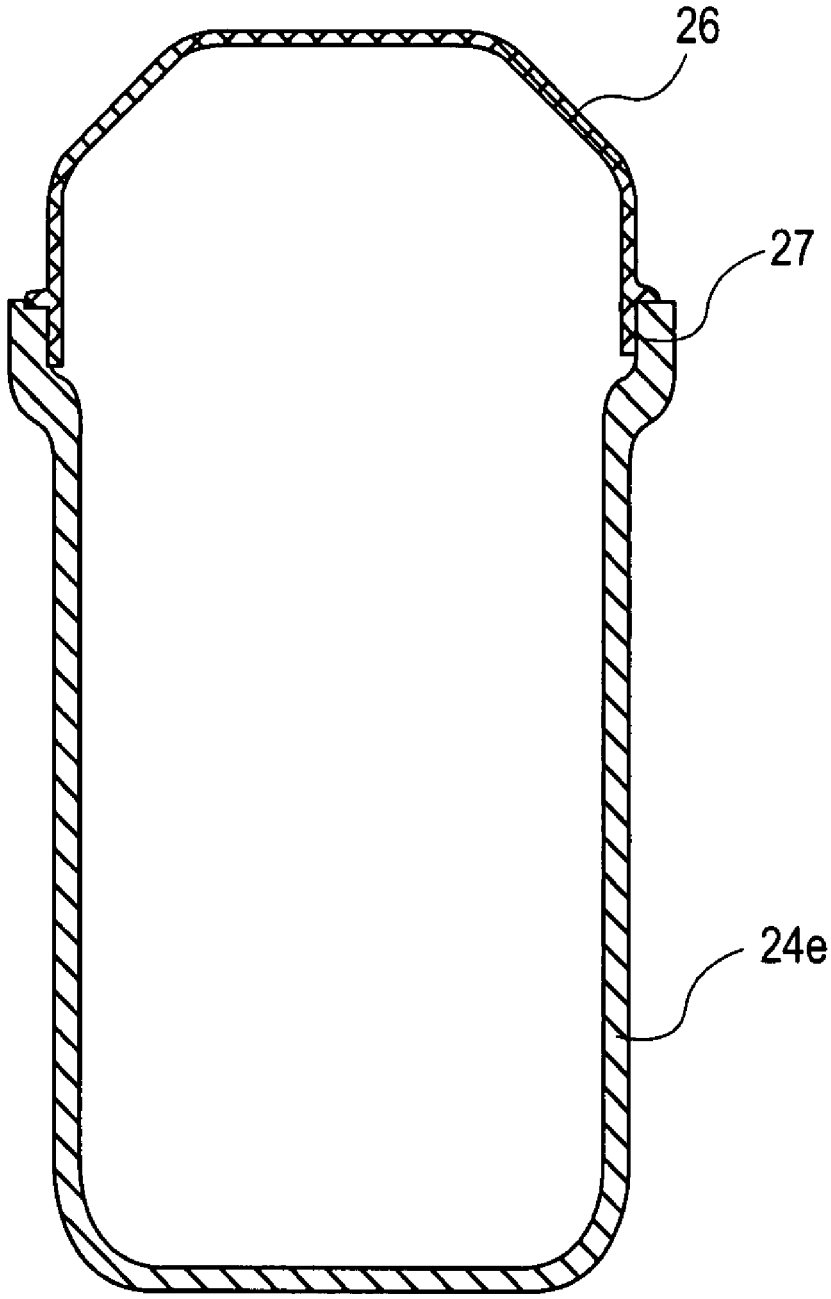
FIG. 9 illustrates a cut side view of an adapter having a rigid lid.

FIG. 9 illustrates a cut side view of an adapter 24*e*, which is stiffened by a rigid lid 26 manufactured from carbon fiber-reinforced plastic. The lid 26 is screwed with the adapter 24*e* by means of a thread 27. The lid 26 acts as a pressure support and thus prevents an ovalization of the adapter 24*e*. In addition to its support effect, the lid 26 closes the adapter 24*e* tightly.

Figure 10:
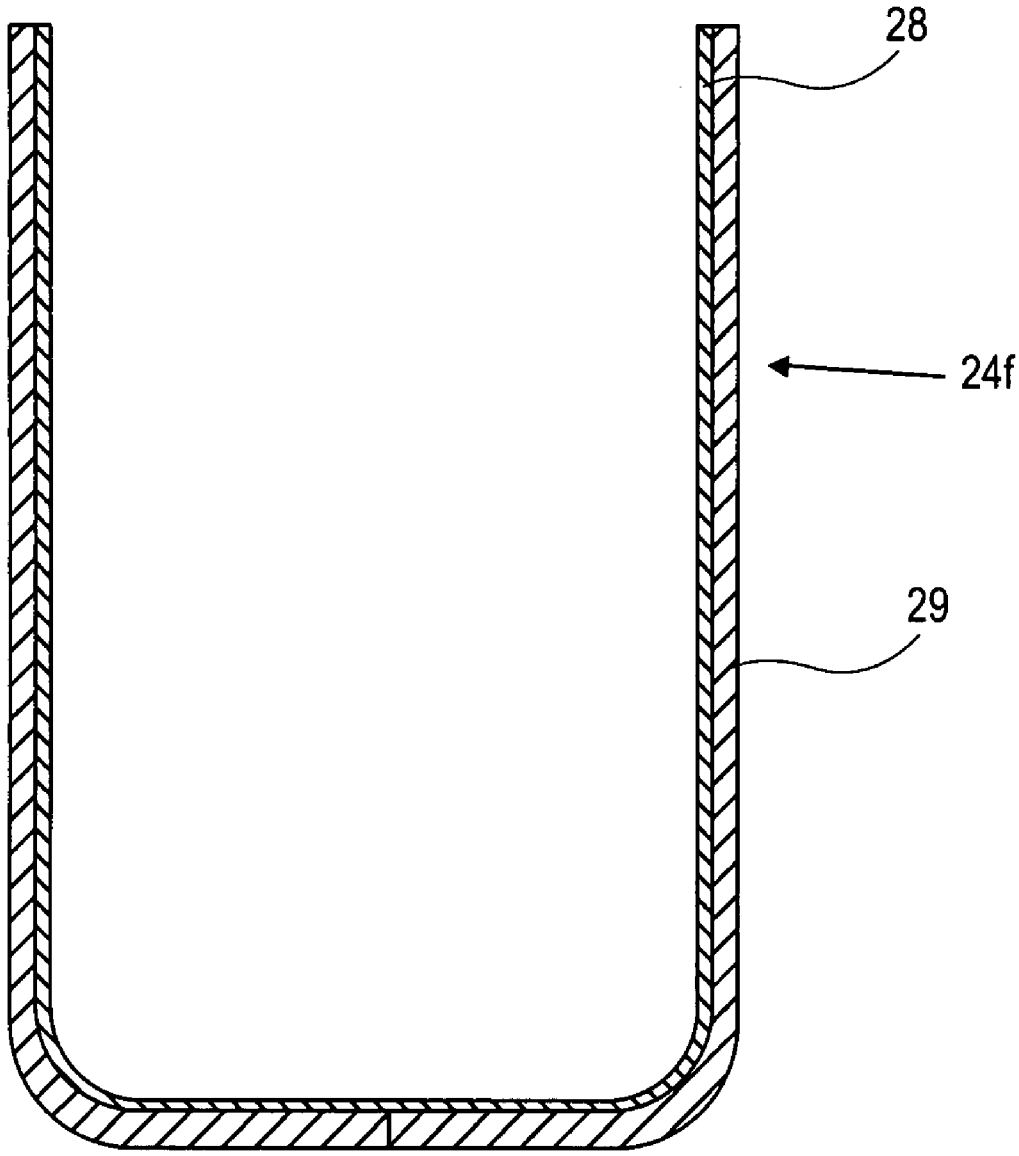
FIG. 10 illustrates a cut side view of an adapter having a liner.

FIG. 10 illustrates a cut side view of an adapter 24*f*. The adapter 24*f* has an internally located liner 28 that is designed as a sleeve. The liner 28 is designed to be continuous and it covers the entire inner surface of the adapter 24*f*. In this embodiment, the liner 28 is manufactured from metal and has a cylindrical geometry. However, the liner can also basically be manufactured in any other geometric shape, for example, elliptical, trapezoid, triangular etc. Around the liner 28 a carbon fiber composite jacket 29 is arranged that is manufactured using the winding technology. When manufacturing the adapter 24*f*, the carbon fibers are wound around the liner 28 so that they form the jacket 29 and completely cover the liner 28.

The invention claimed is:

1. Rotor for laboratory centrifuges comprising:

a rotor housing that is open to the top and at least one recess for taking up centrifuge containers, the recess is formed in the peripheral area of the rotor as a concentric circumferential ring trough having an inner wall and an outer wall, the ring trough is stiffened in a spoke-type manner in such a way using centrifuge containers that are distributed radially and over the circumference of the ring trough that the centrifuge containers support the inner wall and the outer wall rigidly against one another, and the maximum wall thickness of the centrifuge containers in the rotor circumferential direction is greater than the maximum wall thickness of the centrifuge containers in the rotor radial direction.

2. Rotor according to claim 1, wherein the centrifuge containers rest flatly against the inner side of the outer wall.

3. Rotor according to claim 2, wherein the circumferential ring trough has recesses in the area of the inner side of its outer wall and that the centrifuge containers rest in said recesses.

4. Rotor according to claim 3, wherein the recesses each have a first radius that is greater than half the distance (a) between the outer side of the inner wall and the outer side of the outer wall of the ring trough.

5. Rotor according to claim 4, wherein the first radius belongs to a first circular arc segment, each of whose ends is connected to another circular arc segment having a second radius that is smaller than.

6. Rotor according to claim 3, wherein the recesses taper conically towards the bottom of the ring trough.

7. Rotor according to claim 1, further comprised of at least one hold-down device is present by which the centrifuge containers are held in the rotor and secured against axial displacement.

8. Rotor according to claim 1, wherein the centrifuge containers each have a rigid lid for closing and stiffening the centrifuge containers.

9. Rotor according to claim 1, wherein the rotor housing is designed from metal, a metal alloy or fiber-reinforced plastic.

10. Rotor according to claim 1, wherein the centrifuge containers are manufactured at least partly from metal.

11. Rotor according to claim 1, wherein the centrifuge containers are manufactured at least partly using carbon fiber composite design.

12. Rotor according to claim 1, further comprising positioning means being present in the bottom area of the ring trough for positioning the centrifuge containers.

13. An adapter for taking up a sample container and for use in a rotor for laboratory centrifuges, with said rotor including a rotor housing that is open to the top and including at least one recess for taking up at least one adapter, the recess is formed in the peripheral area of the rotor as a concentric circumferential ring trough including an inner wall and an outer wall, the adapter comprising:

a maximum wall thickness of the adapter in the rotor circumferential direction being greater than the maximum wall thickness of the adapter in the rotor radial direction; and an oval-shaped outer contour of the adapter, wherein the adapter rests with the area of the vertex points of its long sides against the inner sides of the circumferential ring trough.

14. An adapter according to claim 13, wherein the adapter has a recess eccentrically to its centerline and that the sample container can be inserted into said recess.

15. An adapter according to claim 13, wherein the adapter is permanently glued to the inner surface of the ring trough.

16. An adapter for taking up a sample container and for use in a rotor for laboratory centrifuges, comprising:

said rotor including a rotor housing that is open to the top and including at least one recess for taking up at least one adapter, the recess is formed in the peripheral area of the rotor as a concentric circumferential ring trough having an inner wall and an outer wall, with the maximum wall thickness of the adapter in the rotor circumferential direction being greater than the maximum wall thickness of the adapter in the rotor radial direction, and the adapter has a triangular outer contour, wherein it rests with one side flatly against the inner side of the outer wall of the circumferential ring trough.

* * * * *